US005349917A

United States Patent [19]

May

[11] Patent Number: 5,349,917

[45] Date of Patent: Sep. 27, 1994

[54] UNITARY ALUMINUM WATERCRAFT AND METHOD OF PRODUCTION OF SAME

[75] Inventor: Billy D. May, Quincy, Fla.

[73] Assignee: Marine Research and Development, Inc., Quincy, Fla.

[21] Appl. No.: 5,462

[22] Filed: Jan. 19, 1993

Related U.S. Application Data

[63] Continuation of Ser. No. 788,545, Nov. 6, 1991, abandoned.

[51] Int. Cl.[5] ..... B63B 3/00

[52] U.S. Cl. ..... 114/347; 114/356

[58] Field of Search ..... 114/347, 356, 65 R, 114/79 R, 85; 72/296, 297

[56] References Cited

U.S. PATENT DOCUMENTS

| | | | |
|---|---|---|---|
| 2,483,531 | 10/1949 | De Boisblanc | 114/347 |
| 2,684,489 | 7/1954 | Porter, Jr. | 114/356 |
| 3,195,154 | 7/1965 | Swanson | 114/356 |
| 3,262,301 | 7/1966 | Langworthy | 72/296 |
| 3,427,671 | 2/1969 | Livaudais | 114/356 |
| 3,435,470 | 4/1969 | Krenzler | 114/357 |
| 3,599,257 | 8/1971 | Erickson | 114/347 |
| 3,742,745 | 7/1973 | Swenson, Sr. | 114/356 X |

*Primary Examiner*—Sherman Basinger
*Attorney, Agent, or Firm*—Arthur G. Yeager

[57] ABSTRACT

A unitary aluminum watercraft is constructed from a single sheet of deep-formable aluminum by forcing a mold into the sheet to imprint the mold into the sheet and then forcing the perimeter portions around the mold. Excess sheet material is removed and than placed into a replica mold. A deck is installed and bonded to the interior bottom surface of the body by a structural flotation foam, such as urethane, to form a unitized structural beam which eliminates the need for a keel and the accompanying structural ribs and below-waterline rivets usually required.

20 Claims, 3 Drawing Sheets

UNITARY ALUMINUM WATERCRAFT AND METHOD OF PRODUCTION OF SAME

This is a continuation of copending application Ser. No. 07/788,545 filed on Nov. 6, 1991 and now abandoned.

BACKGROUND OF THE INVENTION

1. Field of the Invention

The present invention relates to watercraft, particularly to canoes and to a method to construct a canoe out of a single sheet of aluminum and to eliminate the need for a keel in the design and associated rivets, particularly rivets below the waterline.

2. Prior Art

All aluminum canoes made today are constructed of two pieces, a left side and right side which are connected by rivets to a keel. In addition, aluminum canoes usually employ several structural ribs to improve strength and rigidity. The net results are that a standard 16 foot canoe may have 500 rivets located below the waterline, each of which is a potential leak. Furthermore, a large number of rivets can weaken the material because of the large number of holes formed for the rivets. Also, the holes can act as stress risers further aggravating problems of metal fatigue and shortening use life of the canoe. Finally, rivet heads below the waterline can be broken by underwater obstructions and create drag.

Accordingly, what is desired is a canoe that has a unitary smooth body with no rivets or other penetrating structural components below the waterline. In addition, the canoe should be constructed from aluminum because of its light weight, corrosion resistance, and resistance to degradation caused by ultraviolet light from the sun.

What is also most desirable in canoes is an asymmetrical hull design wherein the bow is narrower than usual in order to reduce drag associated with the entry of the hull into water.

Finally, a canoe design and construction should minimize thermal conduction through the floor and reduce the noise often associated with aluminum canoes.

Present canoe designs and methods of construction are inadequate and do not provide the strength, the long life, the low drag and the light weight needed for modern canoes.

SUMMARY OF THE INVENTION

In one aspect of the present invention, a method of producing a watercraft for passengers having a unitary body comprises the steps of forming a unitary watercraft body from a single unitary sheet of metal; fabricating a rigid floor adaptable for attachment to the watercraft body; and attaching the floor to the watercraft body. In other aspects another step is included which comprises placing the sheet from the forming step into a replica female mold prior to the attaching step, and the attaching step includes the steps of rigidly holding a floor member above the bottom interior surface of the watercraft body at a predetermined fixed height; and injecting an expanding foam through openings in the floor member into the space between the interior surface of the watercraft and the lower surface of the floor member that will adhere to the respective surfaces when it cures. The placing step includes the steps of placing the formed body in a mold substantially conforming to the exterior surface of the body for rigidly supporting the body in position; and removing excess material from the body to conform it to substantially the desired dimensions of the watercraft. The invention also directed to the additional steps of placing the formed body in a first mold substantially conforming to the exterior surface of the body for supporting the body in position therein; removing excess material from the body to substantially conform it to the desired dimensions of the watercraft; removing the body from the first mold; and placing the trimmed body in a second mold conforming to the replica exterior surface of the body of the watercraft for rigidly supporting the body in position therein.

In other aspects, preferably the forming step includes the steps of providing a mold in a desired shape corresponding substantially to the body of the watercraft; forcing the mold into the sheet of metal to cause the sheet to imprint the shape of the mold onto the sheet; forcing the perimeter portion of the sheet onto the mold; and removing the formed sheet from the mold. The forming step also includes the steps of cutting a pair of oppositely disposed notches in the ends of the sheet each of which is aligned with the centerline of the sheet; providing a mold in a desired shape of a body of a watercraft onto which the sheet is to be formed; grasping each end of the sheet substantially along the entire length of the end portion adjacent each notch; forcibly pivoting each of the grasped ends in an arc about an axis along the centerline of the sheet to force the perimeter portion of the sheet onto the mold; releasing the grasped ends of the sheet; and removing the sheet from the mold. The forcibly pivoting step includes the step of forcibly pulling outwardly on the grasped ends of the sheet in a direction in line with the sheet centerline to place the sheet under tension for further forcing of the sheet onto the mold.

In another aspect of the present invention there is provided the steps of providing a mold in a desired shape corresponding substantially to the body of the watercraft; cutting a pair of oppositely disposed notches in the ends of the sheet each of which is aligned with the centerline of the sheet; grasping each end of the sheet substantially along the entire length of the end portion adjacent each notch; forcing the mold into the sheet of metal to cause the sheet to imprint the shape of the mold onto the sheet; forcibly pivoting each of the grasped ends in an arc about an axis along the centerline of the sheet to force the perimeter portion of the sheet onto the mold; releasing the grasped ends of the sheet; removing the sheet from the mold; providing a replica female mold; rigidly holding a floor member above the bottom interior surface of the watercraft body at a predetermined fixed height; injecting an expanding urethane foam through openings in the floor member into the space between the interior surface of the watercraft body and the lower surface of the floor member that will adhere to the respective surfaces when it curves; releasing the floor member after the foam injected in step M has cured; removing the watercraft from the female mold; and joining together respective notched end portions at each end of the body.

In another aspect of the present invention, a passenger watercraft is provided and includes a unitary sheet metal body including a lower portion having an interior surface and opposite end portions; a rigid floor member extending from one said end portion to the other said end portion and having an upper surface and a lower surface; and means for attaching said floor member to said body above said lower surface. Other features include means for attaching including a substantially rigid material, the interior surface of the body and lower surface of the floor member defining a cavity, the cavity being substantially filled by the material, the material adhering to each of the interior and lower surfaces to attach the floor member to the body and provide substantial support throughout the floor and minimize deflection of the lower portion of the sheet metal body. The rigid material is chemically expanded structural flotation, urethane foam and the sheet metal is a sheet of deep-formable aluminum. The floor member includes a plurality of spaced ports for the injection of the means for attaching therethrough, a plurality of closure members respectively capping each of the ports after injection of the means for attaching has been terminated. The sheet metal body is smooth and continuous throughout a portion below a waterline of the watercraft to minimize drag and to maximize resistance to leaks and is in the form of a canoe having symmetrical and opposed sides and having assymmetrical end portions. The rigid floor member is substantially planar and the means for attaching is a rigid structural flotation foam material which adheres to each of the floor member lower surface and the interior surface of the lower end portion of the metal body to form a unitized structural beam throughout the extent of the floor member and the lower end portion of the metal body.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE PREFERRED EMBODIMENT

Introduction

Figure 1:
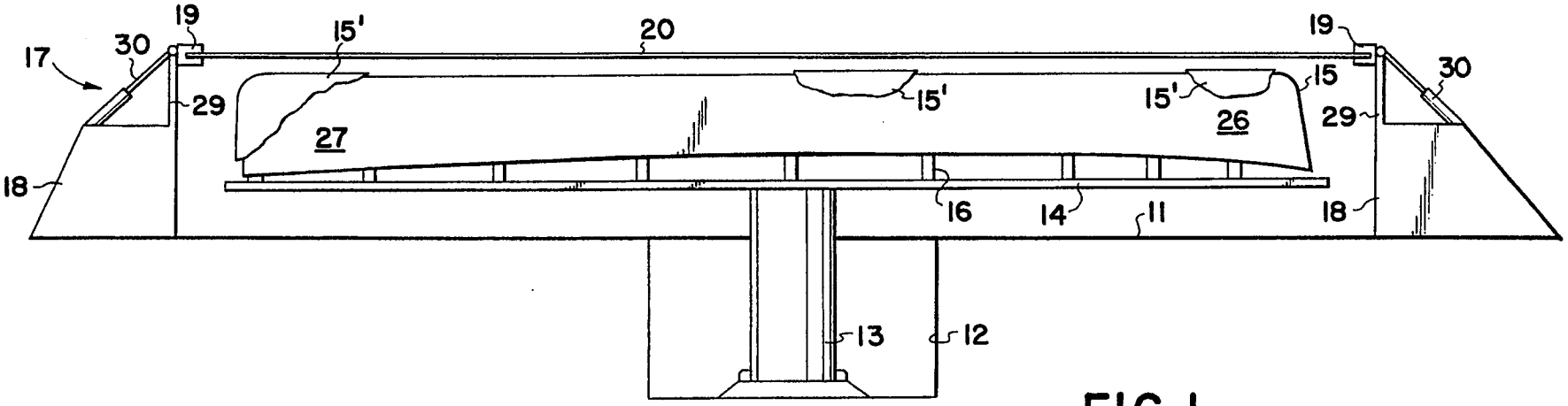
FIG. 1 is a side elevation view of a canoe mold and associated hydraulic equipment used in accord with the present invention.

The present invention involves the design of a watercraft such as a canoe having a unitary body and a method of manufacturing it. The principal design and method of construction is based upon aluminum materials that allow for "deep-forming" of shapes and structures from a single flat sheet of the material and advanced hydraulic controls for controlling the process. Accordingly, it is now possible to form or "imprint" an entire canoe body from a single flat sheet of aluminum to thus avoid the need for rivets and other construction apparatus below the waterline.

The body is formed by forcing a mold of the desired canoe shape into the aluminum sheet to imprint or impress the bottom shape of the canoe into the sheet. Then, the perimeter portion of the sheet is pulled downward over the mold to cause the sheet to more or less wrap onto the mold and thereby complete the general shape of the body. These steps in body forming are preceded by cutting notches in the ends of the sheet before forming and in order to prevent warpage. Each side of the end portions of the sheet with reference to the notch is then grasped along its entire edge by a clamp or jaws. The jaws hold the sheet stationary during the forcing of the mold into the sheet from below. With the bottom imprinted, the jaws are pivoted about the notch causing the perimeter portion of the sheet to be forced downwardly onto the mold. The jaws are hydraulically operated and are pulled outwardly after the pivot movement to place tension on the sheet to assist in imprinting the sides of the mold into the sheet. The jaws are then released and the body is removed from the mold.

The formed but incomplete body is now placed in a female mold that conforms to the desired shape of the final form. The excess aluminum will extend above this form where it can be cut away to provide the final dimension of the canoe.

The trimmed body is now placed in another female mold of the exact shape of the final canoe design. This mold is specifically designed to withstand high internal pressures that result during the forming of the floor section. The deck or floor is installed in the canoe body and welded to the sides of the canoe. Preferably, the floor is made of aluminum. Alternately, a jig is used to lower the floor into the body of the canoe. The jig employs a planar panel resting above and on the deck to prevent movement thereof. If the floor is welded to the body, a jig is also used to place a panel on the deck to secure it in place and hold it rigidly against movement.

A void or region is created below the floor and the interior bottom surface of the canoe body by the placement of the floor in the body against the sides thereof. Structural flotation material such as urethane foam is injected through predetermined injection ports formed in the floor and jig panel into the void. Preferably, the injection process proceeds from one end of canoe to the other and, as each portion of the void is filled, closure members are used to cap or close the injection port. The urethane foam expands as it cures generating considerable pressure against the floor, held rigidly in place via the jig, and the bottom of the body, which is thus forced against the mold to finalize the shape of the exterior lower surface of the body. The caps also eliminate the need to clean up excess foam.

The foam expands and completely fills the region below the deck and, because it is so "tacky" before it cures, it will adhere to the interior surfaces that define the region. This structure will form a "unitized" beam the length of the canoe and thus eliminate the need for a keel or the structural ribs usually used in canoe construction. The unitized foam structure dampens vibration, reduces noise, provides flotation, provides thermal insulation, and reduces deflection and bending of the canoe via the unitized structural beam construction. The flat surface of the deck is easier to clean and is also safer as it provides a more stable surface for the user. In addition, no holes or fasteners below the waterline are needed or used.

The canoe body can be removed from the replica mold and completed by welding the stem ends closed, and installing gunwales and other accessories and equipment.

Quite importantly, the present method of construction allows for canoe designs that are asymmetrical about a transverse center line. More specifically, the present invention contemplates a canoe that is wider near the aft portion and narrower at the bow portion than conventional designs. This feature provides for a narrow portion leading into the water which results in a faster canoe with less drag.

The molds used to construct the canoe can be single-piece or two-piece devices depending upon the curvature of the canoe sides and the ease or difficulty in removing a particular canoe design from a given mold.

Forming the Canoe Body

Figure 2:
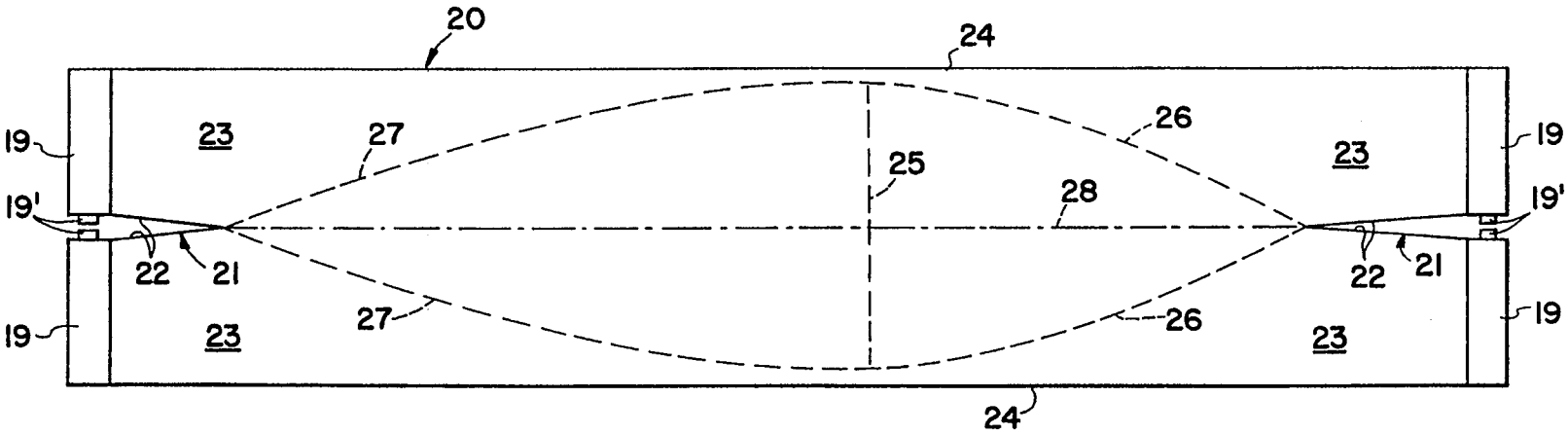
FIG. 2 is a top plan view of the aluminum sheet of the present invention attached to the hydraulic equipment of FIG. 1.

With respect now to the drawings, FIGS. 1 and 2 illustrate the set up and apparatus used to form a canoe body which is depicted at numeral 10. A concrete floor 11 has a pit 12 wherein a conventional hydraulic jack 13 is mounted and operated in the usual manner. Mounted on the jack 13 is a canoe-mold frame 14 which supports a canoe mold 15 via struts 16.

Also positioned on floor 11 at either end of the mold assembly 10 are identical hydraulic units 17 rigidly stationed on mounts 18. Each hydraulic unit 17 has a pair of clamps or jaws 19 which are hinged in the center and pivotal downwardly in an arc with respect to hinge 19'. A pre-cut sheet 20 of deep-formable aluminum is held by the jaws 19 at its respective end portions 23 and is cut to define notches 21 having sides 22 that are aligned with the centerline 25 of sheet 20 and hinge 19'. The sheet 20 is rectangular in shape with long sides 24 spaced apart to provide a width that is at least one foot beyond the greatest width of the canoe mold 15 on either side.

The canoe mold 15 itself is further defined by rearward sides 26 and forward sides 27 that are symmetrical about a centerline 28 but not necessarily symmetrical about the transverse line 25 located at the location of greatest width.

Each hydraulic system 17 includes a pivot means 29 attached to the respective jaws 19 for forcing each jaw 19 downwardly in a pivot action with respect to the hinge 19'. Each hydraulic system 17 also includes a tension means 30 such as a hydraulic ram which provides for the forcible movement of the jaws 19 away from the mold 15 to place tension on the sheet 20. Preferably, both hydraulic units 17 are operable simultaneously and in cooperation to provide for canoe body forming without warpage during the process.

Figure 3:
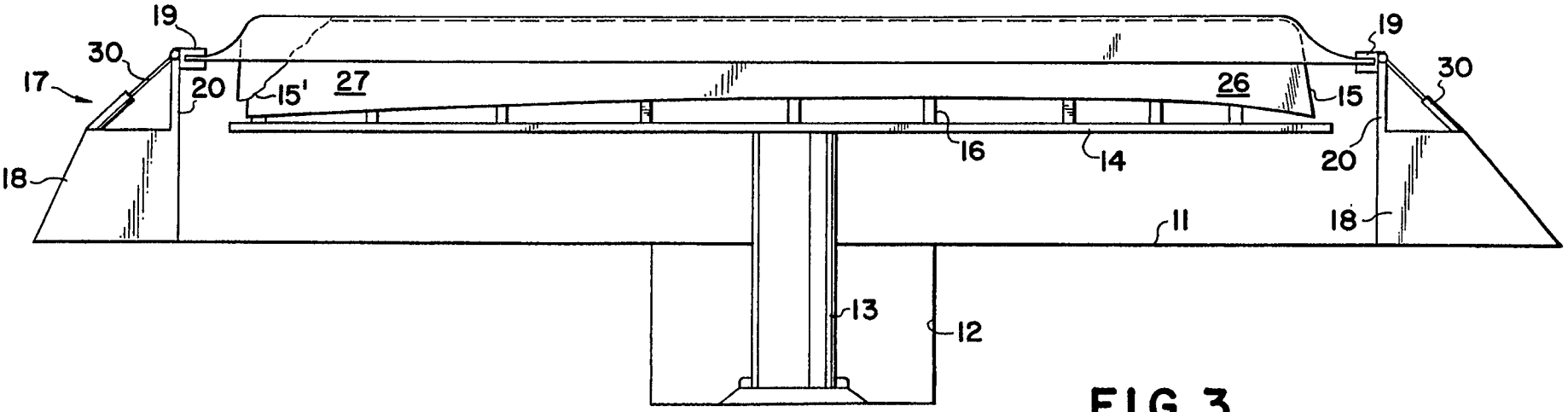
FIG. 3 is a side elevation view of the sheet of FIG. 2 to illustrate the forming of the bottom of the canoe body.

A canoe body is formed by first forcing the canoe mold 15 into the aluminum sheet 20 from below by raising the hydraulic jack 13 (FIG. 3) and pulling to stretch the sheet 20. This step causes the formation of an imprint or impression of the bottom portion of the body in sheet 20. The jaws 19 are then pivoted under force via the respective hydraulic system 17 about the hinges 19' to cause the perimeter portion of the sheet 20, as represented by the portions adjacent sides 24, to be forced down over the mold 15. Further pull-back force is applied to sheet 20 and the mold 15 is moved upwardly a short distance. The notches 21 will also assist in the prevention of sheet 20 warpage during this step. When the jaws 19 have been pivoted downwardly to the generally vertical position, the tension means 30 is operated to pull on jaws 19 in a direction that is away from the mold 15 which is moved upwardly but on the centerline 28 to complete the forming of the sides of the canoe body. At this time, the force from the pivot and tension means 29 and 30, respectively, can be released. The sheet 20 has now been formed as a canoe body 31 having the general shape of the desired canoe.

The canoe mold 15 is preferably covered during the forming process by a rubber sheet 15' (a portion of which is shown in FIG. 1). Sheet 15' provides a means to form the canoe body 31 in a manner that results in a smoother body surface. Sheet 15' also protects mold 15 surface from damage that may accumulate after a series of molding operations. Sheet 15' is preferably rubber but it is to be understood that any similar resilient and protective material can be used.

Completing the Canoe

Figure 4:
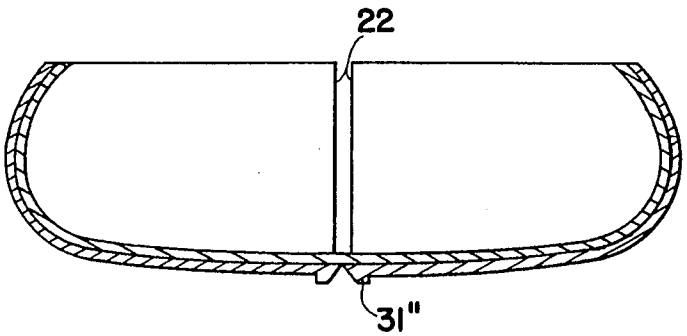
FIG. 4 is a cross-sectional view of the canoe body in a mold for cutting the body to proper dimensions.

Once formed, the canoe body 31 is a shell-like structure that is removed from the canoe mold 15 and placed in a second female canoe mold 31' which matches the exterior surface of the desired canoe. Extra material that extends above mold 31' is trimmed away as necessary (FIG. 4). At this step the body 31 is cut to the dimensions of the final shape and removed from the mold 31'. It is then placed in a second mold 32 which is an exact female replica of the desired exterior shape of the canoe. Unlike mold 31', mold 32 is specifically designed to withstand the high internal forces that will result during the formation of the floor portion of the canoe.

Figure 5:
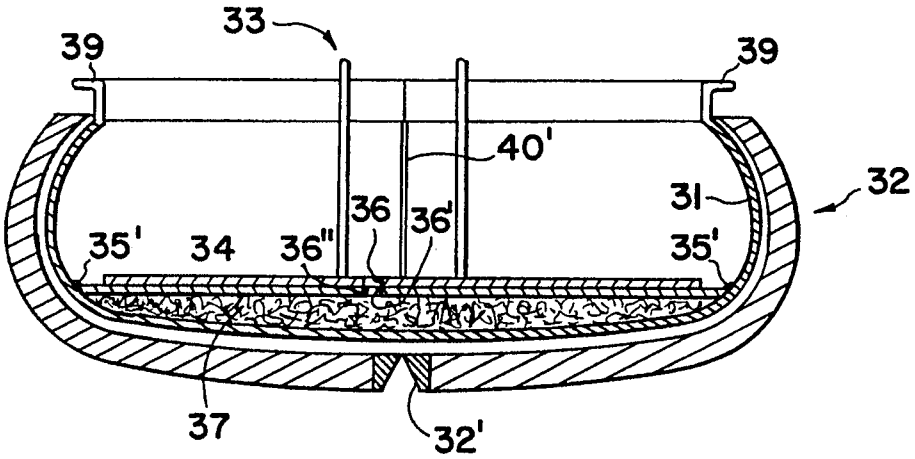
FIG. 5 is a cross-sectional view of the canoe body in a second mold illustrating the unitized floor and the apparatus used to form it.

The canoe is completed by first placing a substantially planar floor panel 35 into the canoe body 31 as illustrated in FIG. 5. The floor panel 35 is preferably made of aluminum and is welded at area 35' to the canoe body 31. A jig, illustrated generally at 33, is used to lower a generally planar floor support plate or panel 34 against the floor 35. Jig 33 includes hold down apparatus to rigidly secure panel 34 into position and prevent its movement. Panel 34 includes a plurality of foam injection ports 36 that align with ports 36' that are drilled into floor 35. A structural flotation foam such as urethane foam 37 is injected into a first port 36 near one end of the floor 35. As soon as the desired amount of foam 37 is injected, the foam injection wand (not shown) is withdrawn and a closure member or cap 36'' is installed to prevent foam 37 from expanding outwardly onto the surface of floor 35. The foam 37 is injected by moving the wand from one port 36 to another down the length of tile floor 35. The foam 37 is very "sticky" in liquid form and adheres to the interior surface 38 of the canoe body bottom and to the lower surface of floor 35. As the foam 37 expands and cures, it generates pressure against the bottom surface 38 of the canoe body 31 and will force it against the mold 32 thereby finalizing the shape of the body 31. The foam 37 completely fills the region below floor 35 and cures as a single continuous solid.

Figure 6:
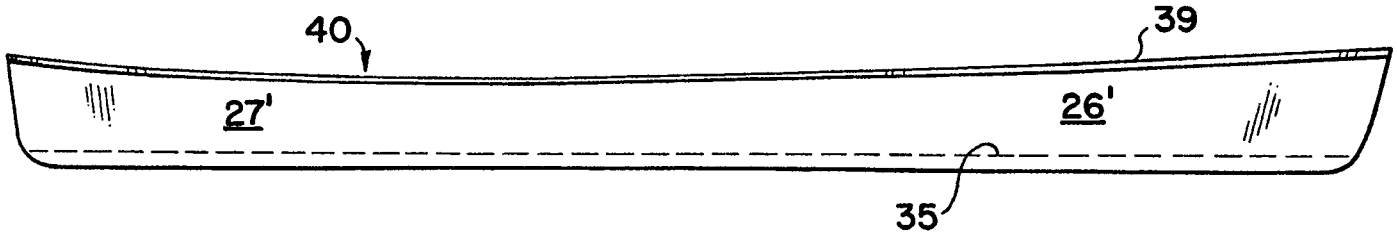
FIG. 6 is a side elevation view of a completed canoe in accord with the present invention.

After the foam 37 has cured, the canoe 40 is completed by welding the ends or "stems" along weld 40' and installing gunwales 39 and other accessories (not shown) as desired in tile circumstance all of which can be done without the use of rivets or other hull connections below the water line. This can be done while the canoe 40 is in the mold 32 or after it has been removed. Molds 15, 31' and 32 may be two-piece molds operable by hinges 31'' and 32' respectively, as desired depending upon the geometry of tile canoe sides. The completed canoe 40 is illustrated in FIG. 6 with the sides 26' and 27' corresponding to the geometry of portions 26 and 27 of canoe mold 15.

Additional ports 36, 36' may be used and spaced laterally depending upon the size of the canoe 40 to be built.

It is also important to note that floor 35 is preferably made of aluminum and can be welded on the perimeter at 35' if desired. Alternatively, however, a fiberglass floor could be used and attached by glue or other means to body 31. No specific material need be used, however, as the adhering properties of the foam 37 will provide the proper unitized beam that is desired.

It is to be understood that the method of forming the floor as a unitized beam is applicable to other canoe designs including plastic-hull boats and aluminum canoes not necessarily constructed from a single sheet of aluminum as is the case of the preferred embodiment.

In the forming procedures actually used for form injection, vacuum pump apparatus (not shown) may be used and if so, it is connected to the "downstream" ports 36 to assist in the removal of air from the void space below the deck 35 during injection of foam 37.

In the preferred embodiment of the present invention, FIG. 33 includes heat sink and clamp apparatus to prevent warpage of the canoe body 31 during the welding process whereby floor or deck 35 is secured therein if it is desired to weld the deck 35 in place. Also, mold 32 is preferably a hydraulically operated device in a "clamshell" structure. The hydraulic assist provides sufficient force to maintain the canoe body 31 closed and in place under the pressure of foam 37 expansion.

Finally, the size and length of notches 21 is dependent upon the precise size and shape of the canoe mold 15 and the desired canoe 40.

The process by which the canoe body 31 is formed depends upon modern hydraulic systems that allow the various steps to be accomplished in a smooth continuous manner. The steps involve first, the lifting of the canoe mold 15 against the aluminum sheet 20 which is under a stretching force via hydraulically operated jaws 19. Second, the jaws 19 are pivoted downwardly and further stretching force is applied. Third, the mold 15 is lifted upwardly against sheet 20 and further stretching force is applied along with further pivotal action of jaws 19 followed by further stretching force. The combination of these steps results in the necessary shape of the canoe body 31 as well as necessary structural change in the aluminum itself to accomplish the desired canoe body properties and shape. Accordingly, the shape of the canoe body 31 is "fixed" and will not warp or undergo deformation resulting from any "memory" of any intermediate step.

It is important to point out that the specific steps taken are designed to ensure the proper shape of canoe body 31 and that other steps may accomplish the desired result. For example, the sheet 20 can be lowered against mold 15 rather than lifting the mold 15 as described above.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A method of producing a watercraft for passengers having a unitary body comprising the steps of:

A. forming a unitary watercraft body from a single unitary sheet of deep-formable metal;

B. providing a mold in a desired shape corresponding substantially to the body of the watercraft;

C. forcing the mold into the sheet of metal to cause the mold to imprint the shape of the mold onto the sheet;

D. fabricating a rigid floor adaptable for attachment to the watercraft body; and E. attaching the floor to the watercraft body.

2. The method of claim 1 further comprising the step of:

F. placing the sheet from step C into a replica female mold prior to step E and wherein step E includes the steps of;

G. rigidly holding a floor member above the bottom interior surface of the watercraft body at a predetermined fixed height;

H. injecting an expanding foam through openings in the floor member into the space between the interior surface of the watercraft and the lower surface of the floor member that will adhere to the respective surfaces and form a single continuous solid when it cures.

3. The method of claim 2 wherein step H includes the step of:

I. injecting urethane foam.

4. The method of claim 2 wherein step F includes the steps of:

I. placing the formed body in a mold substantially conforming to the exterior surface of the body for rigidly supporting the body in position; and J. removing excess material from the body perimeter to conform it to substantially the desired dimensions of the watercraft.

5. The method of claim 2 further including the steps of:

I. placing the formed body in a first mold substantially conforming to the exterior surface of the body for supporting the body in position therein;

J. removing excess material from the body perimeter to substantially conform it to the desired dimensions of the watercraft;

K. removing the body from the first mold; and

L. placing the trimmed body in a second mold conforming to the replica exterior surface of the body of the watercraft for rigidly supporting the body in position therein.

6. The method of claim 1 wherein step A includes the steps of:

F. forcing the perimeter portion of the sheet onto the mold; and

G. removing the formed sheet from the mold.

7. The method of claim 1 wherein step C includes the steps of:

F. cutting a pair of oppositely disposed notches in the ends of the sheet each of which is aligned with the centerline of the sheet;

G. grasping each end of the sheet substantially along the entire length of the end portion adjacent each notch;

H. forcibly pivoting each of the grasped ends in an arc about an axis along the centerline of the sheet to force the perimeter portion of the sheet onto the mold;

I. releasing the grasped ends of the sheet; and

J. removing the sheet from the mold.

8. The method of claim 7 wherein step H includes the step of:

K. forcibly pulling outwardly on the grasped ends of the sheet in a direction in line with the sheet centerline to place the sheet under tension for further forcing of the sheet onto the mold.

9. The method of claim 1 further including the steps of:

F. cutting a pair of oppositely disposed notches in the ends of the sheet each of which is aligned with the centerline of the sheet;

G. grasping each end of the sheet substantially along the entire length of the end portion adjacent each notch;

H. forcing the mold into the sheet of metal to cause the sheet to imprint the shape of the mold onto the sheet;

I. forcibly pivoting each of the grasped ends in an arc about an axis along the centerline of the sheet to force the perimeter portion of the sheet onto the mold;

J. releasing the grasped ends of the sheet;

K. removing the sheet from the mold;

L. providing a replica female mold;

M. rigidly holding a floor member above the bottom interior surface of the watercraft body at a predetermined fixed height;

N. injecting an expanding foam through openings in the floor member into the space between the interior surface of the watercraft body and the lower surface of the floor member that will adhere to the respective surfaces when it cures;

O. releasing the floor member after the foam injected in step N has cured;

P. removing the watercraft from the female mold; and

Q. joining together respective notched end portions at each end of the body.

10. A passenger watercraft comprising:

a unitary unfolded sheet metal body including a lower portion having an interior surface and opposite side portions and opposite end portions, said body being forcibly molded of deep-formable metal without folding thereof, said lower portion of said body having a continuous bottom throughout without welds below a waterline of said watercraft to minimize drag and to maximize resistance to leaks, said body having welds upstanding from said bottom at said opposite end portions;

a rigid floor, said floor including a substantially planar floor member having an upper surface and lower surface, said floor member being located adjacent said lower portion and extending between said end portions and said side portions and contacting thereabout said interior surface of said lower portion; and means for attaching said floor member to said lower portion of said body between said interior surface of said lower portion of said body and said lower surface of said floor member, said means including a unitized structural beam engaged throughout said lower surface of said floor member and extending throughout the extent of said body lower portion below said floor member.

11. The watercraft as defined in claim 10 wherein said unitized structural beam consists of material formable into a substantially rigid continuous solid, said interior surface of said body lower portion and said lower surface of said floor member defining a cavity, said cavity being substantially filled by said material, said material adhering to throughout each of said interior and lower surfaces to attached said floor member to said body lower portion to become a rigid solid and provide substantial support throughout said floor member and minimize deflection of said lower portion of said metal body.

12. The watercraft as defined in claim 11 wherein said material is chemically expanded foam.

13. The watercraft as defined in claim 11 wherein said material is structural flotation foam.

14. The watercraft as defined in claim 10 wherein said sheet metal is aluminum.

15. The watercraft as defined in claim 10 wherein said floor member includes a plurality of spaced ports for the injection of said means for attaching therethrough, a plurality of closure members respectively capping each of said ports after injection of said means for attaching has been terminated.

16. The watercraft as defined in claim 10 wherein said body is in the form of a canoe having symmetrical and opposed sides and having asymmetrical end portions.

17. The watercraft as defined in claim 16 wherein said unitized structural beam includes a structural flotation foam material formable into a single continuous solid which adheres to each of said floor member lower surface and said interior surface of said lower portion of said metal body.

18. The watercraft as defined in claim 10 wherein said beam is a structural flotation foam material formable into a single continuous solid which adheres to each of said floor member lower surface and said interior surface of said lower portion of said metal body and occupies the space therebetween to form a single continuous solid.

19. The watercraft as defined in claim 10 wherein said rigid floor is sheet metal.

20. The watercraft as defined in claim 19 wherein said means for attaching includes welding said rigid floor to said interior surface of said lower portion of said body.

* * * * *